US008111154B1

(12) United States Patent
Puri et al.

(10) Patent No.: US 8,111,154 B1
(45) Date of Patent: Feb. 7, 2012

(54) SYSTEMS AND METHODS FOR MONITORING A MOBILE-COMPUTING DEVICE USING GEO-LOCATION INFORMATION

(75) Inventors: Hemant Puri, Milpitas, CA (US); Anand Kashyap, San Jose, CA (US); Sanjay Sawhney, Cupertino, CA (US)

(73) Assignee: Symantec Corporation, Mountain View, CA (US)

( * ) Notice: Subject to any disclaimer, the term of this patent is extended or adjusted under 35 U.S.C. 154(b) by 397 days.

(21) Appl. No.: 12/559,456

(22) Filed: Sep. 14, 2009

(51) Int. Cl.
*G08B 1/08* (2006.01)

(52) U.S. Cl. ..... 340/539.13

(58) Field of Classification Search ..... 340/539.13, 340/539.15, 506, 13.24, 573.1; 455/456.1, 455/411
See application file for complete search history.

(56) References Cited

U.S. PATENT DOCUMENTS

2004/0183674 A1* 9/2004 Ruvarac ..... 340/539.13
2006/0030339 A1* 2/2006 Zhovnirovsky et al. ... 455/456.6
2007/0200695 A1* 8/2007 Almstrand et al. ..... 340/539.13
2007/0243869 A1* 10/2007 Kwon et al. ..... 455/435.1
2010/0222645 A1* 9/2010 Nadler et al. ..... 600/300

OTHER PUBLICATIONS

Google Latitude; accessed on Jul. 21, 2009; http://www.google.com/latitude/intro.html.
Child Safety Products; Find Your Child; accessed on Jul. 21, 2009; http://www.findyourchild.net/articles/child_safety_products.html.
BrickHouse Child Locator: Keep a Watchful Eye on Your Wandering Child; Brick House Security; accessed on Jul. 21, 2009; http://www.brickhousesecurity.com/locator.html.
mTrack i-Kids Child Safety Location Phone; www.66mobile.com; accessed on Jul. 21, 2009; http://www.66mobile.com/news/mTrack-i-Kids-Child-Safety-Location-Phone-347.html.
Sprint Family Locator; Sprint; accessed on Jul. 21, 2009; http://sfl.sprintpcs.com/finder-sprint-family/signIn.html.
"BlackBerry asset management, data protection and geolocation tracking;" www.net-security.org; Feb. 25, 2009; http://www.net-security.org/secworld.php?id=7093.
Computrace Technology; Absolute Software; accessed Jul. 21, 2009; http://www.absolute.com/products/computrace-technology.
Tracks 4 Africa; accessed on Sep. 6, 2009; www.tracks4africa.com.
Polygonal Geofencing—An Industry First; sentryGPS id; accessed on Sep. 6, 2009; http://sentrygpsid.com/GPS/gps-news/polygonal-geofencing-industry.

(Continued)

*Primary Examiner* — Phung Nguyen
(74) *Attorney, Agent, or Firm* — Advantedge Law Group

(57) ABSTRACT

A computer-implemented method for monitoring a mobile-computing device using geo-location information is disclosed. The method may include a learning phase. During the learning phase, a user may be located within a first range of physical locations during a recurring time period. The method may include generating a location profile for a mobile-computing device of the user and receiving a device-monitoring policy for the mobile-computing device from an administrator. The location profile may correlate the first range of physical locations with the recurring time period. The method may further include detecting, after the learning phase, that the mobile-computing device is outside the first range of physical locations during a first instance of the recurring time period. The method may also include implementing the device-monitoring policy after detecting that the mobile-computing device is outside the first range of physical locations during the first instance of the recurring time period.

20 Claims, 7 Drawing Sheets

OTHER PUBLICATIONS

Shoes With Built-in GPS for Alzheimer's Patients; Impact Lab; Sep. 6, 2009; http://www.impactlab.com/2009/06/06/shoes-with-built-in-gps-for-alzheimers-patients/.

International® AwareTM Vehicle Intelligence; International Aware; accessed on Aug. 6, 2009;.

"GeoFencing and Alerts"; GeoMicro; accessed on Aug. 6, 2009; http://www.geomicro.com/capabilities/geofencing.asp.

"CVO01-Fleet Administration (Market Package*);" Iteris, Inc.; accessed on Aug. 6, 2009; http://www.iteris.com/itsarch/html/mp/mpcvo01_b.html.

FAQs; iTrack; accessed on Aug. 6, 2009; http://www.itrackindia.com/faqs.html.

Technology by Application; Safe Fright Technology; accessed on Aug. 6, 2009; http://www.safefreight.com/technology-by-application/.

* cited by examiner

SYSTEMS AND METHODS FOR MONITORING A MOBILE-COMPUTING DEVICE USING GEO-LOCATION INFORMATION

BACKGROUND

Children often go about their days according to a fairly consistent and predictable schedule. Children often participate in a set schedule of activities when they are away from the home. Accordingly, parents may expect their children to be located at specific locations at certain times during the week. However, parents are often unable to accompany children at all times. Many parents understand the many dangers posed to children outside of the home and may be concerned for the welfare and safety of their children.

In the age of instant communication, children often carry mobile communication devices, such as mobile phones, when they are away from the home. While parents may contact their children via such mobile communication devices, children may not be willing or able to contact their parents, particularly when the children are planning to go to locations that are not authorized by their parents. Additionally, while the location of some mobile communication devices may be tracked remotely by parents, many parents do not have the necessary time or resources to constantly check the location of the mobile communication devices to ensure their children are located where they are expected to be.

SUMMARY

As will be described in greater detail below, the instant disclosure generally relates to systems and methods for monitoring mobile-computing devices using geo-location information. According to certain embodiments, the method may comprise determining, during a learning phase, that a user is located within a first range of physical locations during a recurring time period. The method may also comprise generating a location profile for a mobile-computing device of the user and receiving a device-monitoring policy for the mobile-computing device from an administrator. The location profile may correlate the first range of physical locations with the recurring time period. The method may additionally comprise detecting, after the learning phase, that the mobile-computing device is outside the first range of physical locations during a first instance of the recurring time period. The method may further comprise implementing the device-monitoring policy after detecting that the mobile-computing device is outside the first range of physical locations during the first instance of the recurring time period. According to various embodiments, the user may be a child and the administrator may be a guardian of the child.

In some embodiments, determining, during the learning phase, that the user is located within the first range of physical locations during the recurring time period may comprise detecting that the mobile-computing device is within one or more physical locations within the first range of physical locations during a plurality of learning instances of the recurring time period. In at least one embodiment, determining, during the learning phase, that the user is located within the first range of physical locations during the recurring time period may comprise detecting that the mobile-computing device is within a first physical location within the first range of physical locations during a first learning instance of the recurring time period and detecting that the mobile-computing device is within a second physical location within the first range of physical locations during a second learning instance of the recurring time period.

In some embodiments, the recurring time period may recur at intervals specified by the administrator and/or according to a schedule specified by the administrator. The location profile may comprise at least one of coordinates within the range of first physical locations, boundaries of the first range of physical locations, and/or address within the first range of physical locations. According to some embodiments, implementing the device-monitoring policy may comprise notifying the administrator that the mobile-computing device is outside the first range of physical locations during the first instance of the recurring time period. Notifying the administrator may comprise at least one of sending an email to the administrator, sending a text message to a mobile-computing device of the administrator, and/or sending an automated phone message to the administrator. According to various embodiments, implementing the device-monitoring policy may comprise telephonically connecting a computing device of the administrator to the mobile-computing device of the user.

In certain embodiments, the method may comprise providing the administrator with access to device-setting policies of the mobile-computing device of a user, receiving a device-setting policy for the mobile-computing device from the administrator, and implementing the device-setting policy on the mobile-computing device after detecting that the mobile-computing device is outside the first range of physical locations during the first instance of the recurring time period. The device-setting policy may comprise at least one of a ringer setting, a lighting setting, a power setting, an email setting, a voicemail setting, a network setting, a sound setting, a camera setting, a global positioning system setting, a messaging setting, a Bluetooth setting, an infrared data-association setting, an installed application setting, and/or a built-in application setting.

In some embodiments, the method may comprise receiving a request to override the device-monitoring policy for the mobile-computing device from the user, sending the override request to the administrator, and/or receiving authorization from the administrator to override the device-monitoring policy. The method may additionally comprise determining, during an update phase, that the user is located within a physical location outside the first range of physical locations during a second instance of the recurring time period and updating the location profile for the mobile-computing device of the user, the location profile correlating a second range of physical locations with the recurring time period. The second range of physical locations may include the physical location outside the first range of physical locations.

According to at least one embodiment, a computer-implemented method for monitoring a mobile-computing device using geo-location information may comprise determining, during a learning phase, that a user is located within a first range of physical locations during a first time period having a first length of time and generating a location profile for a mobile-computing device of the user. The location profile may correlate the first range of physical locations with the first length of time. The method may comprise receiving a device-monitoring policy for the mobile-computing device from an administrator, detecting, after the learning phase, that the mobile-computing device is outside the first range of physical locations during a second time period having a length approximately equal to the first length of time, and implementing the device-monitoring policy after detecting that the mobile-computing device is outside the first range of physical locations during the second time period.

According to some embodiments, the method may also comprise determining, during the learning phase, that the user is located within the first range of physical locations according to a first sequence during the first time period, detecting, after the learning phase, that the mobile-computing device is located within the first range of physical locations according to a second sequence during the second time period, the second sequence differing from the first sequence, and implementing the device-monitoring policy after detecting that the mobile-computing device is located within the first range of physical locations according to the second sequence.

In at least one embodiment, a system for monitoring a mobile-computing device using geo-location information may comprise an interface programmed to receive a device-monitoring policy for a mobile-computing device of a user from an administrator and a profile-management module programmed to generate a location profile for the mobile-computing device. The location profile may comprise a first range of physical locations correlated with a recurring time period. The system may also comprise a monitoring module programmed to detect that the mobile-computing device is outside the first range of physical locations during a first instance of the recurring time period and an enforcement module configured to implement the device-monitoring policy after detecting that the mobile-computing device is outside the first range of physical locations during the first instance of the recurring time period. The system may additionally comprise one or more processors configured to execute the interface, the profile-management module, the monitoring module, and the enforcement module.

In certain embodiments, the interface may comprise at least one of a drop-down menu comprising a first setting option and a second setting option, the device-setting policy comprising the first setting option, a text-box configured to receive input from the administrator, and/or a button configured to allow the administrator to select between the first setting option and the second setting option.

Features from any of the above-mentioned embodiments may be used in combination with one another in accordance with the general principles described herein. These and other embodiments, features, and advantages will be more fully understood upon reading the following detailed description in conjunction with the accompanying drawings and claims.

BRIEF DESCRIPTION OF THE DRAWINGS

The accompanying drawings illustrate a number of exemplary embodiments and are a part of the specification. Together with the following description, these drawings demonstrate and explain various principles of the instant disclosure.

Figure 1:
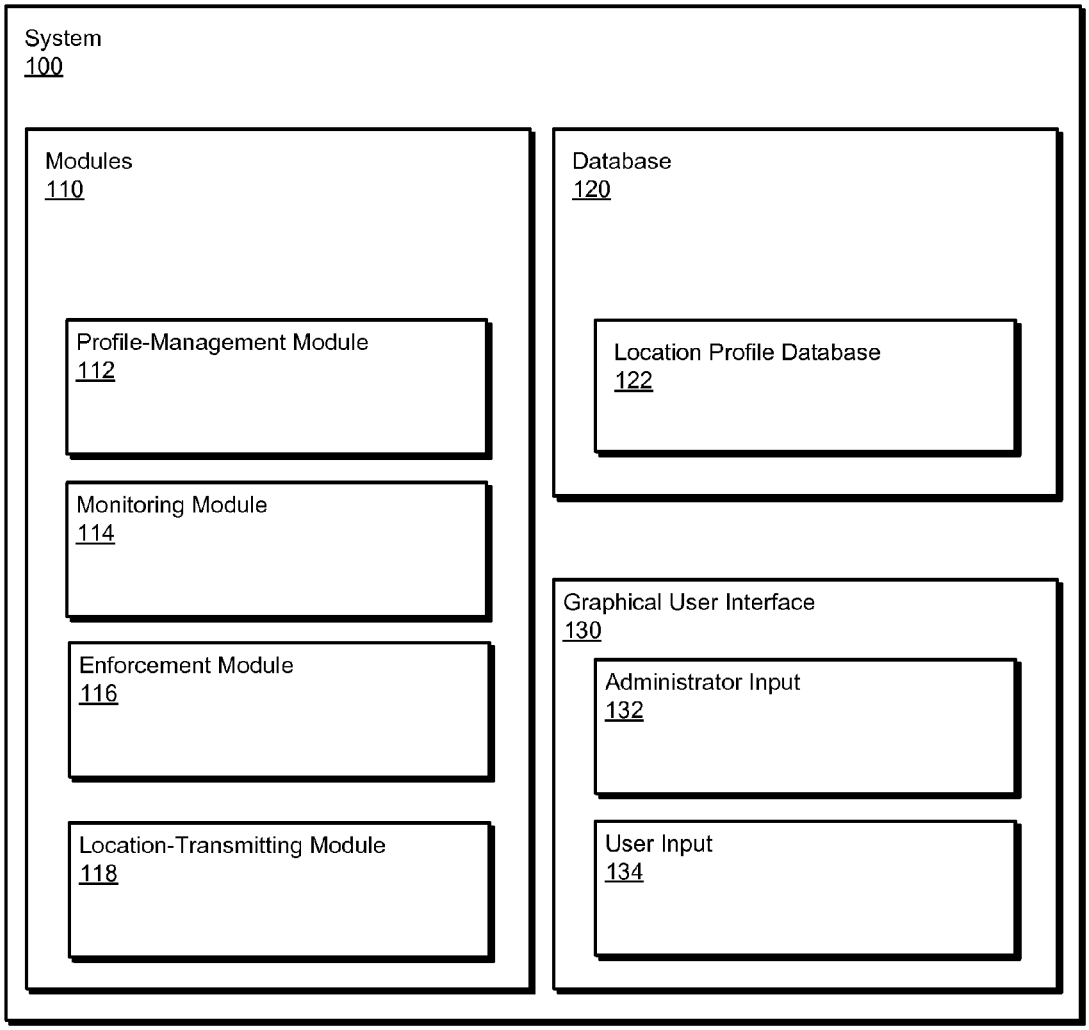
FIG. 1 is a block diagram of an exemplary system for monitoring a mobile-computing device using geo-location information.

Throughout the drawings, identical reference characters and descriptions indicate similar, but not necessarily identical, elements. While the exemplary embodiments described herein are susceptible to various modifications and alternative forms, specific embodiments have been shown by way of example in the drawings and will be described in detail herein. However, the exemplary embodiments described herein are not intended to be limited to the particular forms disclosed. Rather, the instant disclosure covers all modifications, equivalents, and alternatives falling within the scope of the appended claims.

DETAILED DESCRIPTION OF EXEMPLARY EMBODIMENTS

The present disclosure presents various methods and systems for monitoring a mobile-computing device using geo-location information. Embodiments of this disclosure may enable remote monitoring of a mobile-computing device and notification of an administrator when the mobile-computing device is located outside a specified area during a specified time period, in accordance with location-based policies established by the administrator. For example, a parent or guardian of a child may be notified (e.g., via a text message or recorded phone message) when a mobile-computing device carried by the child of the parent is located outside of a specified area (e.g., an area that includes the child's school) during a specified time period (e.g., during school hours on a weekday). As used herein, a "physical location" may refer to location coordinates, location boundaries, a location address, and/or any other suitable location-based identifier.

In certain embodiments, a profile-management module may generate location profiles for the mobile-computing device during various recurring time-periods (e.g., by tracking locations of the mobile-computing device during a learning phase). The administrator may establish a device-monitoring policy specifying areas where the mobile-computing device may be located during specified recurring time-periods (e.g., a recurring time-period during which the child may be expected to be in school), the areas being determined in accordance with the location profiles. A monitoring module may track locations of the mobile device. If the device is outside of a specified area during a specified time-period, in violation of the device-monitoring policy, an enforcement module may notify the administrator of the violation.

Figure 2:
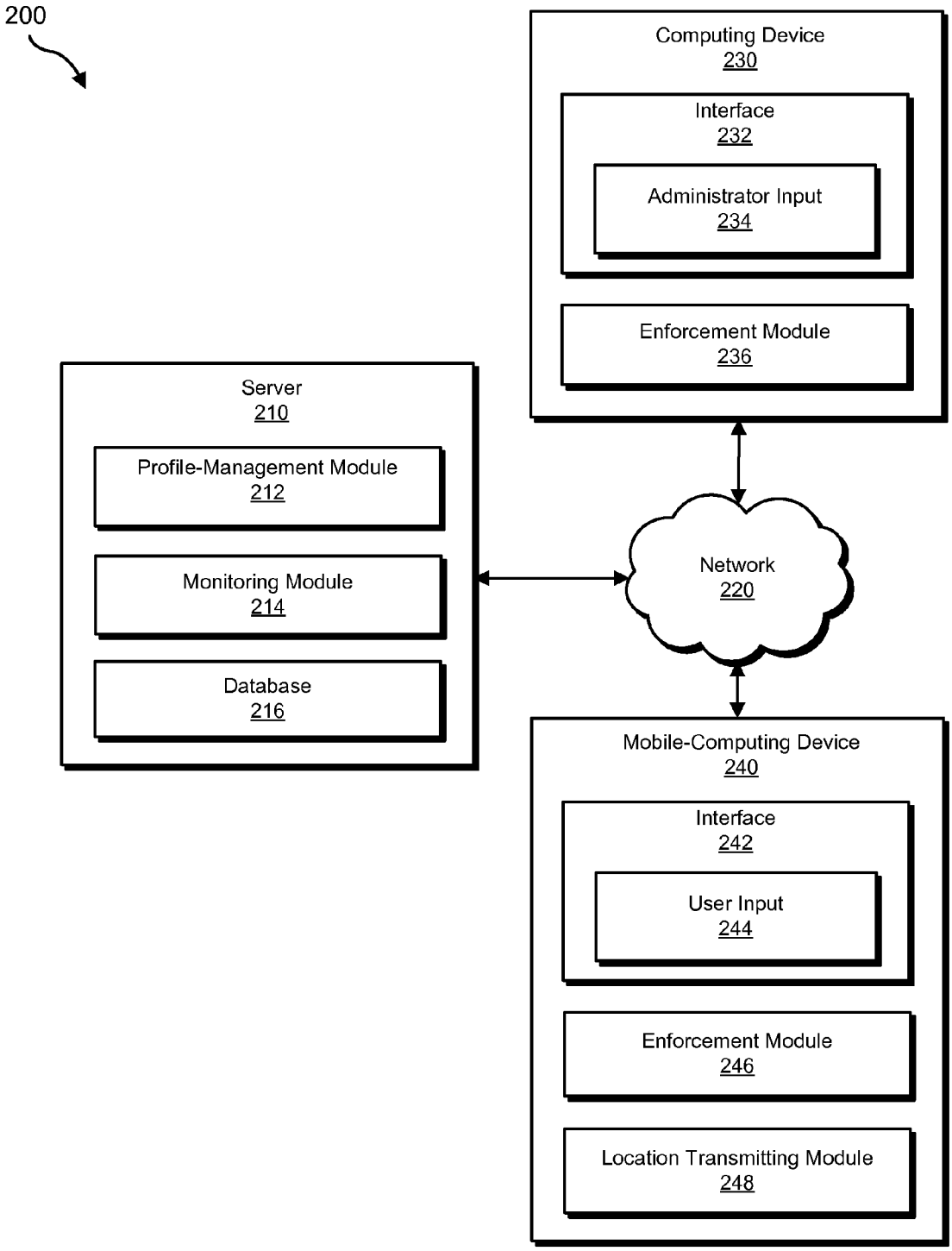
FIG. 2 is a block diagram of another exemplary system for monitoring a mobile-computing device using geo-location information.
Figure 4:
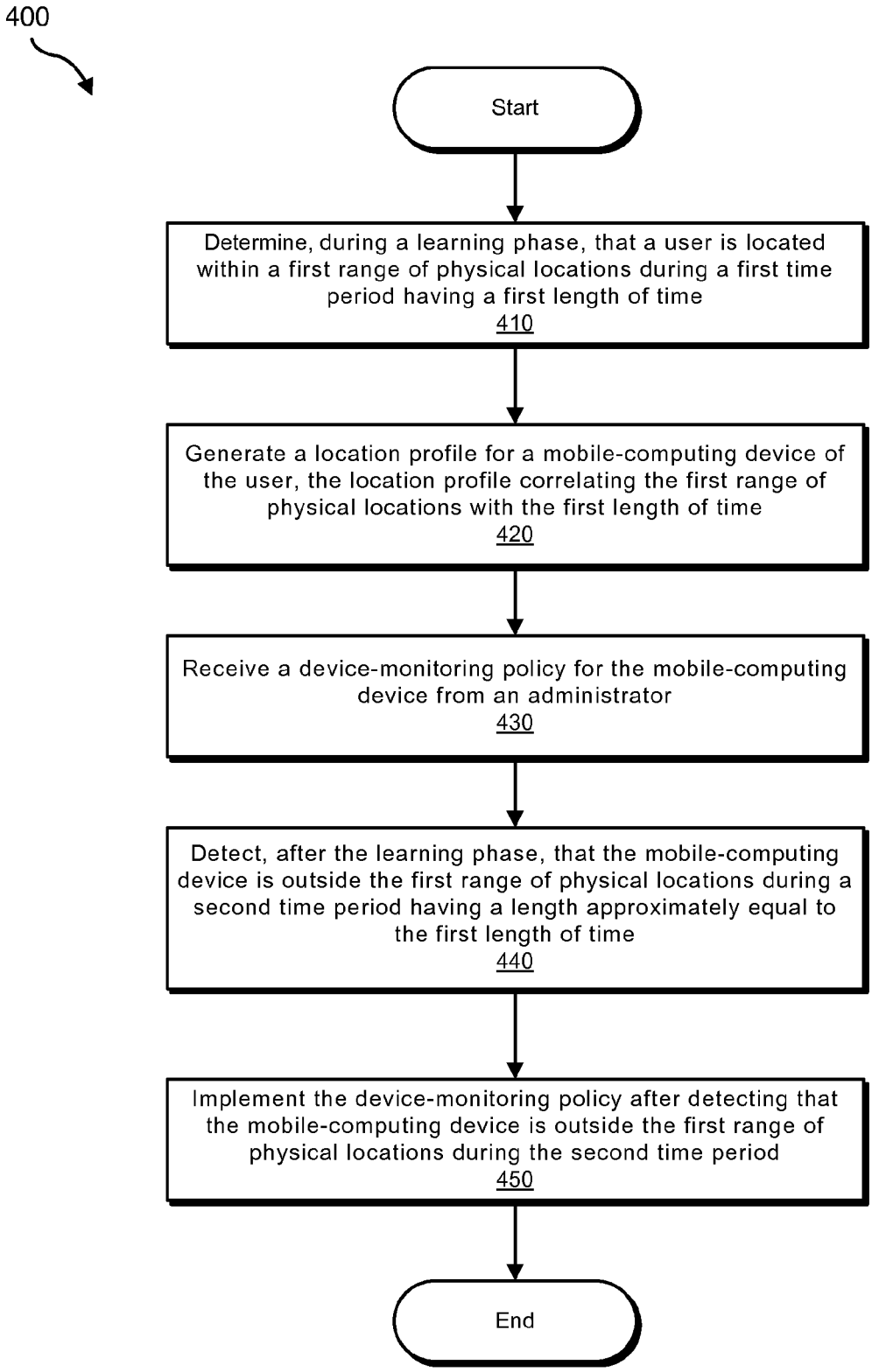
FIG. 4 is a flow diagram of another exemplary method for monitoring a mobile-computing device using geo-location information.
Figure 5:
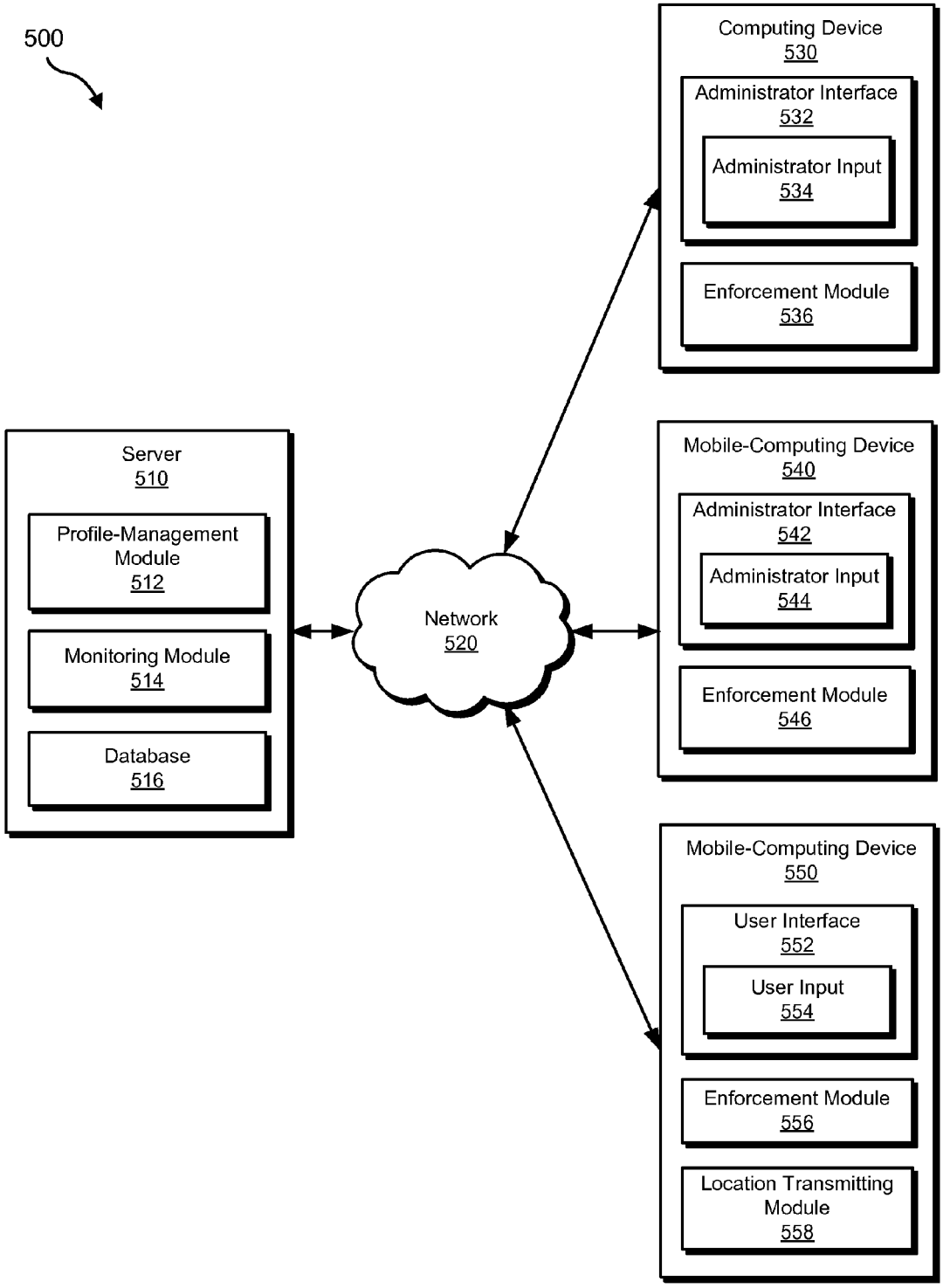
FIG. 5 is a block diagram of another exemplary system for monitoring a mobile-computing device using geo-location information.

The following will provide, with reference to FIGS. 1, 2, and 5, detailed descriptions of exemplary systems for monitoring a mobile-computing device using geo-location information. Detailed descriptions of corresponding computer-implemented methods will also be provided in connection with FIGS. 3 and 4. In addition, detailed descriptions of an exemplary computing system and network architecture capable of implementing one or more of the embodiments described herein will be provided in connection with FIGS. 6 and 7, respectively.

FIG. 1 is a block diagram of an exemplary system 100 for monitoring a mobile-computing device using geo-location information. Exemplary system 100 may include one or more modules 110 for performing one or more tasks. As illustrated in FIG. 1, modules 110 may include a profile-management module 112, a monitoring module 114, an enforcement module 116, and a location-transmitting module 118. Profile-management module 112 may be programmed to generate and manage location profiles for a mobile-computing device of a user, such as a child. The location profiles may include physical locations and/or ranges of physical locations associated with recurring time periods and/or or time periods having specified lengths. Monitoring module 114 may be programmed to track physical locations of the mobile-computing device and detect when the mobile-computing device is located outside one or more specified ranges of physical locations during a time period specified in at least one of the location profiles. Enforcement module 116 may be programmed to implement a device-monitoring policy and/or a device setting policy. For example, enforcement module 116 may implement a device-monitoring policy after monitoring module 114 detects that the mobile-computing device is located outside one or more specified ranges of physical locations during a specified time period. In additional embodiments, location-transmitting module 118 may be programmed to transmit a signal indicating the physical location of the mobile-computing device.

In certain embodiments, one or more of modules 110 in FIG. 1 may represent one or more software applications or programs (e.g., parental-control software) that, when executed by a computing device, may cause the computing device to perform one or more tasks. For example, as will be described in greater detail below, one or more of modules 110 may represent software modules stored and configured to run on one or more computing devices, such as the devices illustrated in FIG. 2 (i.e., server 210, computing device 230, and/or mobile-computing device 240), the devices illustrated in FIG. 3 (i.e., server 510, computing device 530, mobile-computing device 540, and/or mobile-computing device 550), computing system 610 in FIG. 6, and/or portions of exemplary network architecture 700 in FIG. 7. One or more of modules 110 in FIG. 1 may also represent all or portions of one or more special-purpose computers configured to perform one or more tasks.

As illustrated in FIG. 1, exemplary system 100 may also include one or more databases 120. Databases 120 may represent portions of a single database or computing device or a plurality of databases or computing devices. As shown, databases 120 may include a location profile database 122 for storing location profiles associated with one or more mobile-computing devices.

Databases 120 in FIG. 1 may represent portions of one or more computing devices. For example, databases 120 may represent a portion of server 210 in FIG. 2, server 310 in FIG. 3, computing system 610 in FIG. 6, and/or portions of exemplary network architecture 700 in FIG. 7. Alternatively, databases 120 in FIG. 1 may represent one or more physically separate devices capable of being accessed by a computing device, such as server 210 in FIG. 2, server 310 in FIG. 3, computing system 610 in FIG. 6, and/or portions of exemplary network architecture 700 in FIG. 7. Although not illustrated, in certain embodiments a portion of databases 120 may also be stored on one or more of computing device 230 and/or mobile-computing device 240 in FIG. 2 and/or computing device 530, mobile-computing device 540, and/or mobile-computing device 550 in FIG. 3.

In addition to modules 110 and databases 120, exemplary system 100 may include a graphical user interface 130 configured to receive administrator input 132 (e.g., input from an administrator defining a device-monitoring policy for a mobile-computing device). Graphical user interface 130 may also be configured to receive user input 134 (e.g., input from a user requesting a temporary override of the device-monitoring policy). In some embodiments, all or a portion of exemplary system 100 may represent portions of network-based system 200 illustrated in FIG. 2 or network-based system 500 illustrated in FIG. 5.

FIG. 2 is a block diagram of an exemplary system 200 for monitoring a mobile-computing device. As illustrated in this figure, exemplary system 200 may include a server 210 in communication with a computing device 230 and/or a mobile-computing device 240 via a network 220. Server 210 generally represents any type or form of computing device capable of reading computer-executable instructions, including, for example, an application server configured to run certain software applications, and/or a database server configured to provide various database services.

Server 210 may include a profile-management module 212, a monitoring module 214, and a database 216. Profile-management module 212 may generate and manage location profiles for mobile-computing device 240, such as location profiles that include physical locations and/or ranges of physical locations associated with recurring time periods and/or time periods having specified lengths. In some embodiments, location profiles may include specified sequences of physical locations during specified time periods. Monitoring module 214 may track physical locations of mobile-computing device 240 and may detect that mobile-computing device 240 is located outside of a range of physical locations specified in one or more location profiles in profile-management module 212. Database 216 may be configured to store device-setting data, device-location data, and/or any other suitable data, without limitation.

Computing device 230 generally represents any type or form of computing device capable of reading computer-executable instructions. Examples of computing device 230 include, without limitation, laptops, desktops, servers, cellular phones, smart phones, personal digital assistants ("PDAs"), multimedia players, game consoles, embedded systems, combinations of one or more of the same, exemplary computing system 610 in FIG. 6, or any other suitable computing device.

Computing device 230 may include an interface 232 and an enforcement module 236. Interface 232 may include an administrator input 234 configured to receive setting and location input from an administrator. In some embodiments, computing device 230 may comprise a mobile-computing device and interface 232 may comprise an interface accessible to the administrator on the mobile-communication device. Enforcement module 236 may enforce a device-monitoring policy and/or a device-setting policy on computing device 230.

Mobile-computing device 240 may represent any type or form of mobile-computing device, such as a mobile-communication device. Examples of mobile-computing device 240 include, without limitation, cellular phones, smart phones, PDAs, GPS receivers, combinations of one or more of the same, or any other suitable computing device.

Mobile-computing device 240 may include an interface 242, an enforcement module 246, and a location transmitting module 248. Interface 242 may include a user input 244 configured to receive setting and location input from a user. The user may also make policy modification or override requests via user input 244. Enforcement module 246 may enforce a device-monitoring policy and/or a device-setting policy on computing device 240. Location transmitting module 248 may transmit location data, such as coordinates of mobile-computing device 240. For example, mobile-computing device 240 may comprise a GPS receiver and mobile-computing device 240 may transmit locations of mobile-computing device 240 as determined by the GPS receiver.

Network 220 generally represents any medium or architecture capable of facilitating communication or data transfer. Examples of network 220 include, without limitation, an intranet, a wide area network ("WAN"), a local area network ("LAN"), a personal area network ("PAN"), the Internet, power line communications ("PLC"), a cellular network (e.g., a GSM Network), exemplary network architecture 700 in FIG. 7, or the like. In at least one embodiment, network 220 may facilitate communication between server 210, computing device 230, and/or mobile-computing device 240.

In some embodiments, network 220 may also represent a cloud-computing environment capable of performing at least one of the steps disclosed herein, and server 210 may comprise at least a portion of the cloud-computing environment. As used herein, a cloud-computing environment or "cloud" may refer to a scalable collection of network accessible hardware and/or software resources. Cloud computing environments may provide various services and applications via the Internet. These cloud-based services (e.g., software as a service, platform as a service, infrastructure as a service, etc.) may be accessible through a web browser or other remote interface. Various functions described herein may be provided through a remote desktop environment or any other cloud-based computing environment. Network 220 may facilitate communication or data transfer using wireless and/or wired connections. In one embodiment, network 220 may facilitate communication between server 210, computing device 230, and mobile-computing device 240.

Figure 3:
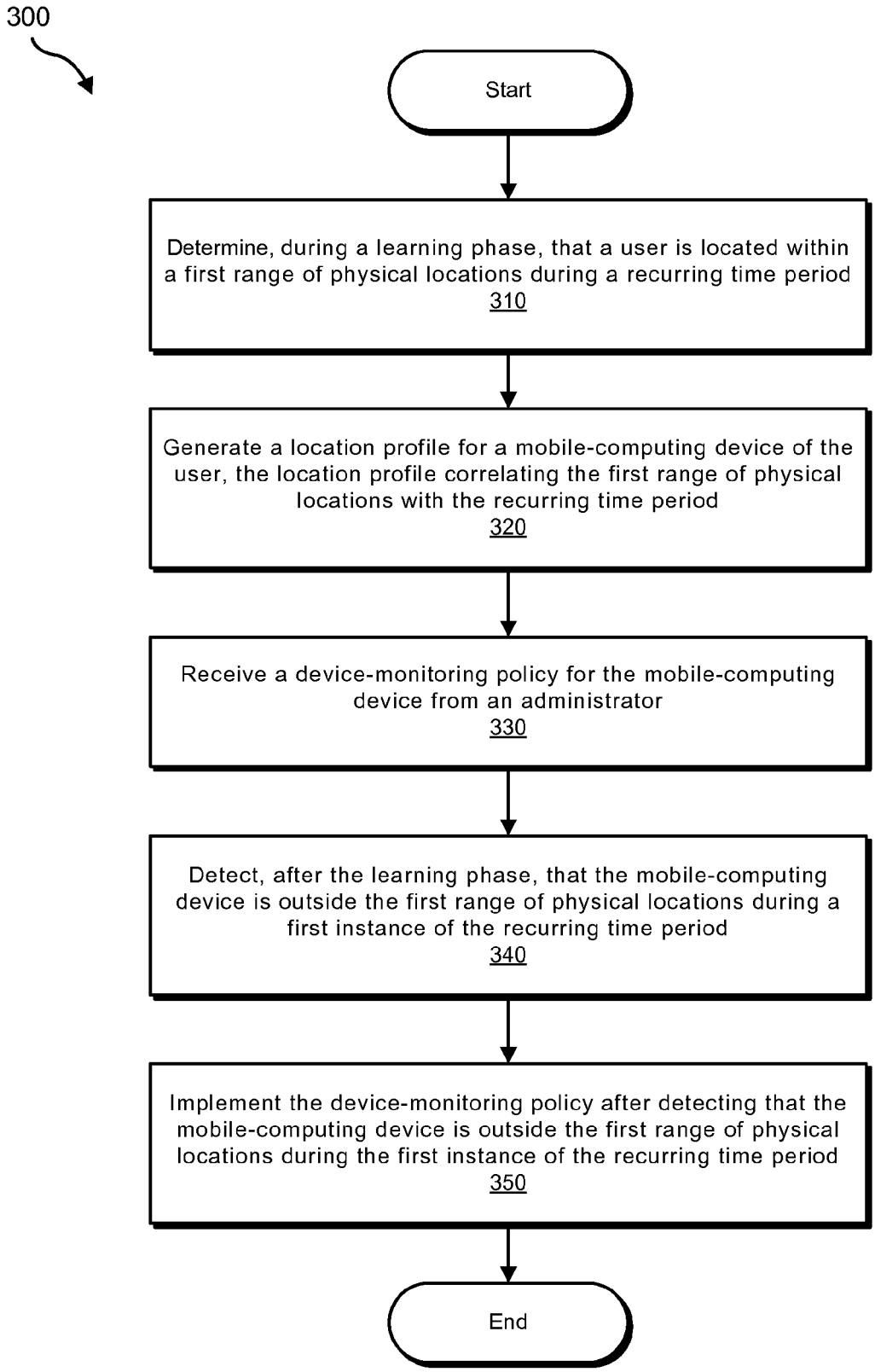
FIG. 3 is a flow diagram of an exemplary method for monitoring a mobile-computing device using geo-location information.

FIG. 3 is a flow diagram of an exemplary computer-implemented method 300 for monitoring a mobile-computing device using geo-location information. The steps shown in FIG. 3 may be performed by any suitable computer-executable code and/or computing system. In some embodiments, the steps shown in FIG. 3 may be performed by one or more of the components of system 100 in FIG. 1, one or more of the elements of system 200 in FIG. 2, and/or one or more of the elements of system 500 in FIG. 5, as will be explained in greater detail below.

At step 310 in FIG. 3, the system may determine that a user is located within a first range of physical locations during a recurring time period. For example, the system may determine that a child is located at a school during selected hours on a weekday. The system may determine that the user is located within the first physical location during a learning phase that includes the one or more instances of the recurring time period. The system may include a learning phase for the purpose of establishing a location profile for the user. During the learning phase, the user's locations at time periods within the learning phase may be determined and/or logged in database 216.

In various embodiments, the learning phase may include a plurality of instances of the recurring time period. For example, a learning phase comprising a term of five days may include a recurring time period that recurs once during each of the five days (e.g., a recurring time period that includes a commute to school). During the learning phase, the system may determine and store locations of the user during each of the plurality of instances of the recurring time period. The system may use the stored locations to determine one or more ranges of physical locations in which the user may be expected to be located during the recurring time period. The ranges of physical locations may include locations where the user was located during one or more of the plurality of instances of the recurring time period during the learning phase. Additionally, the ranges of physical locations may include locations in the vicinity of and/or between locations where the user was located during one or more of the plurality of instances of the recurring time period during the learning phase.

In some embodiments, the system may determine that the user is located within a plurality of physical locations during one or more time periods during the learning phase. According to at least one embodiment, the system may determine that the user is located within the plurality of physical locations according to a certain sequence. For example, during a first instance of a recurring time period during the learning phase, the system may determine that the user is located within a plurality of physical locations according to a first sequence. For example, during a commute to school, the user may be located at several physical locations along the commuting route in a specific sequence.

In various embodiments, monitoring module 214 may be used to track the user's locations during the learning phase. For example, monitoring module 214 may track the user's locations by tracking locations of mobile-computing device 240 carried by the user during the learning phase. In additional embodiments, the user's locations may be manually entered by the user and/or the administrator during the learning phase.

The learning phase may continue for a length of time specified by the administrator. The learning phase may include one or more recurring time periods during which the user participates in activities that are representative of activities that the user typically participates in during the recurring time periods. For example, during the learning phase, a user may be located at a sports playing field during a first instance of a recurring time period, such as a recurring afternoon time period that falls on one or more days of the week during which the user attends a sports practice. The user may be expected to be located at the same sports playing field during recurrences of the recurring time period.

According to various embodiments, the user and/or the administrator may define and/or label various activities associated with one or more of the recurring time periods. For example, during the learning phase, a parent and/or a child may enter the labels "sports practice" or "music lesson" to define recurring time periods during which the child generally participates in the labeled activities. The recurring time periods may recur at intervals specified by the administrator and/or according to a schedule specified by the administrator and/or the user. For example, the administrator may lay out a schedule of calendar days and time periods within those days during which the user is expected to be located at a specified physical location or sequence of locations.

The learning phase may extend for a term specified by an administrator. For example, the learning phase may comprise a period of a week, as specified by the administrator. In some embodiments, subsequent learning phases may be established by the administrator. Such subsequent learning phases may be employed for the purpose of updating location data for the user, such as, for example, after a recurring schedule of the user changes significantly (e.g., after a child begins a new year of school).

At step 320 in FIG. 3, the system may generate a location profile for a mobile-computing device of the user. For example, profile-management module 212 may generate a location profile for mobile-computing device 240. The location profile may correlate the first range of physical locations with the recurring time period. In some embodiments, the location profile may correlate a plurality of physical locations with the recurring time period. In additional embodiments, the location profile may correlate a sequence of locations with the recurring time period. The location profile may comprise data representing physical locations, such as physical locations of mobile-computing device 240 that were determined during the learning phase. The location profiles may comprise data representing at least one of location coordinates within the first range of physical locations, boundaries of the first range of physical locations, and/or addresses within the first range of physical locations.

According to various embodiments, profile-management module 212 may generate and/or store one or more location profiles and/or sub-profiles for mobile-computing device 240. In some examples, profile-management module 212 may generate different profiles and/or sub-profiles associated with different activities and/or different time periods. For example, a first location profile may be associated with a first user activity and/or time period and a second location profile may be associated with a second user activity and/or time period. In some embodiments, the one or more location profiles for a first mobile-computing device of a user may be associated with a second mobile-computing device for the user. For example, a first mobile-computing device of a user may be replaced with a second-mobile computing device and one or more location profiles associated with the first mobile-computing device may also be associated with the second mobile-computing device. In some embodiments, a plurality of users may use a single mobile-computing device at different times, and different location profiles may be associated with each of the plurality of users.

At step 330 in FIG. 3, the system may receive a device-monitoring policy for the mobile-computing device from an administrator. In some examples, the administrator may input the device-monitoring policy into interface 232 of computing device 230, into an internet interface, or into any other suitable computer interface. In at least one example, the device-monitoring policy may be stored in profile-management module 212. The device-monitoring policy may specify actions to be enforced by the system if mobile-computing device 240 is located outside of a specified area or range of physical locations during a specified time period. For example, the device-monitoring policy may specify that an administrator be notified if a mobile-computing device is located outside of a defined area or range of areas during a specified time period.

The device-monitoring policy may be associated with one or more location profiles for the mobile-computing device. For example, the device-monitoring policy for mobile-computing device 240 may be associated with a location profile that correlates several physical locations with a first recurring time period. The device-monitoring policy may specify that an administrator be notified if the system detects that, during an instance of the first recurring time period, mobile-computing device 240 is located more than a specified distance outside one or more of the physical locations associated with the location profile.

In some examples, the device-monitoring policy may specify that the administrator be notified if the system detects that, during an instance of the first recurring time period, mobile-computing device 240 is located outside of a certain range of physical locations for a length of time that is longer than a length of time specified in the location profile. The device-monitoring policy may also specify that the administrator be notified if the system detects that, during an instance of the first recurring time period, mobile-computing device 240 is located in a plurality of physical locations in a sequence that differs to a specified degree from a sequence of physical locations in the location profile.

According to some examples, the device-monitoring policy may associate several location profiles and/or sub-profiles with a particular recurring time period. Accordingly, more than one physical location or range of physical locations may comprise an acceptable location for mobile-computing device 240 during the recurring time period. For example, a child may have two or more friends who live at two or more separate locations. The child may be authorized by their parent to go to the home of either of the two friends during a recurring time period. Accordingly, a first location profile or sub-profile may associate a first range of physical locations that includes a home of a first friend with the recurring time period and a second location profile or sub-profile may associate a second range of physical locations that includes a home of a second friend with the same recurring time period. The device-monitoring policy may specify that no action is to be taken if the child is located within either the first physical location or the second physical location during an instance of the recurring time period.

The device-monitoring policy may specify actions to be taken by the system if specified conditions are met. For example, the device-monitoring policy may specify that the administrator be notified if mobile-computing device 240 is located outside of a specified area or range of areas during a specified time period. In some examples, notifying the administrator may comprise at least one of sending an email to an email address of the administrator, sending a text message to a mobile-computing device of the administrator, and/or sending an automated phone message to a computing device or communication device of the administrator. In additional embodiments, the device-monitoring policy may also specify that the user be notified if mobile-computing device 240 is located outside of a specified area during a specified time period.

In various examples, the device-monitoring policy may specify that the administrator and the user be telephonically connected in specified circumstances. For example, the device-monitoring policy may specify that computing device 230 of the administrator be telephonically connected to mobile-computing device 240 of the user if mobile-computing device 240 is located outside of a specified area or range of areas during a specified time period.

In at least one embodiment, the administrator may be provided with access to device-setting policies of mobile-computing device 240 of the user. The administrator may establish a device-setting policy for mobile-computing device 240. For example, the administrator may establish a policy that modifies one or more device settings of mobile-computing device 240 if certain specified conditions occur. For example, the device-setting policy may modify one or more device settings of mobile-computing device 240 if mobile-computing device 240 is located outside of a specified area or range of areas.

In at least one example, the device-setting policy may enable the administrator to be automatically connected with the user when the user is outside of a specified area or range of areas. In various embodiments, settings included in the device-setting policy may comprise, without limitation, ringer settings, lighting settings, power settings, email settings, voicemail settings, network settings, sound settings, camera settings, GPS settings, messaging settings, Bluetooth settings, infrared data-association settings, installed application settings, and/or built-in application settings. For example, the device-setting policy may specify that mobile-computing device 240 be set to a loud ringer setting if the user is located outside of a specified area or range of areas during an instance of a recurring time period.

According to various embodiments, the administrator may modify one or more policy settings. The administrator may also override one or more policy settings of the device-monitoring policy and or the device-setting policy. For example, the administrator may temporarily override the device-monitoring policy during a time period when the user will not be at a location specified in the device-monitoring policy during an instance of a recurring time period (e.g., during a vacation week when a child will not be in school).

In some embodiments, the user may request that one or more policy settings be modified and/or overridden. For example, the user may desire to go to a location other than one specified in the device-monitoring policy implemented on mobile-computing device 244 for a particular time period. The user may enter a request to override and/or modify the device-monitoring policy for the particular time period. In some examples, the user may enter the override request into interface 242 of mobile-computing device 240, or any other suitable computing interface that the user has access to. In at least one embodiment, interface 242 may include fields for the user input details or select from a list of options indicating the reason the user is requesting a policy override.

The request to override and/or modify the device-monitoring policy may be sent to the administrator via interface 232 of computing device 230 or via any other suitable computing interface that the administrator has access to. The administrator may respond to the override request by authorizing a full or partial override of the device-monitoring policy in accordance with the override request or by denying the override request. Only partially fulfilling the override request may comprise modifying or overriding fewer policy settings and/or different policy settings than those requested by the user. In some embodiments, the administrator may use interface 232 to request additional information from the user before accepting or denying the override request.

At step 340 in FIG. 3, the system may detect, after the learning phase, that the mobile-computing device is outside the first range of physical locations during a first instance of the recurring time period. For example, monitoring module 114 may detect that mobile-computing device 240 is located at a location outside of the first range of physical locations and/or outside of an authorized area during a time period specified by the device-monitoring policy. As described above, the device-monitoring policy may specify parameters for mobile-computing device 240. Such parameters may include, without limitation, time periods, and/or lengths of time in which mobile-computing device 240 may be located within specified physical locations and/or ranges of physical locations. Such parameters may also include sequences in which mobile-computing device 240 may be located in the physical locations and/or ranges of physical locations. An exception to the device-monitoring policy may occur when mobile-computing device 240 is located at a physical location that is outside of a specified range of physical locations in accordance with one or more of the specified parameters.

When an exception to the device-monitoring policy occurs, monitoring module 214 may detect that such an exception has occurred. In some embodiments, monitoring module 214 may track physical locations of mobile-computing device 240 using any suitable tracking technique. For example, monitoring module 214 may track coordinates of a signal transmitted by mobile-computing device 240. In some embodiments, mobile-computing device 240 may comprise a location transmitting module 248 that transmits a signal indicating the physical location of mobile-computing device 240. In various embodiments, mobile-computing device 240 may transmit a signal when the physical location of mobile-computing device 240 changes.

For example, mobile-computing device 240 may comprise a GPS device configured to receive GPS coordinates of mobile-computing device 240. Location transmitting module 248 may transmit such GPS coordinates to server 210 and/or to computing device 230 via network 220. In some embodiments, a physical location of mobile-computing device 240 may be determined using a local area network that utilizes high frequency radio signals, such as a wireless fidelity ("WiFi") network. For example, a WiFi network may be used to determine that mobile-computing device 240 is within range of the network. WiFi may be utilized, for example, when mobile-computing device 240 is indoors or otherwise out of range of a GPS signal. In additional embodiments, cellular phone tower localization may also be used to determine a physical location of mobile-computing device 240.

According to some embodiments, the system may occasionally lose track of the physical location of mobile-computing device 240, such as when mobile-computing device 240 is indoors or otherwise unable to receive or transmit a signal that can be used to detect the physical location of computing device 240, such as when mobile-computing device 240 is out of range of a GPS signal, WiFi signal, and/or cellular phone signal. Additionally, the system may lose track of the physical location of mobile-computing device 240 and/or a user when mobile-computing device 240 is turned off, when the battery dies, and/or when the user is not carrying mobile-computing device 240.

When the physical location of mobile-computing device 240 may not be determined directly using signal-based location updates, monitoring module 214 may use dead-reckoning to estimate the location of mobile-computing device 240 based on previously received signals suggesting a direction and/or rate of travel of mobile-computing device 240. Additionally, monitoring module 214 may use one or more location profiles in profile-management module 212 and/or other stored location tracking data to predict the physical location of mobile-computing device 240 at a particular time. In some embodiments, a combination of dead-reckoning and location-profile-based predictions may be used to extrapolate possible locations for mobile-computing device 240 and/or for a user of mobile-computing device 240.

When monitoring module 214 receives data indicating the physical location of mobile-computing device 240, monitoring module 214 may determine whether the physical location is outside any specification parameters in the device-monitoring policy. In some embodiments, monitoring module 214 may determine whether mobile-computing device 240 is outside certain specification parameters in relation to one or more location profiles. For example, a first location profile may specify a first range of physical locations during a recurring time period and a second location profile may specify a second range of physical locations during a recurring time period. The device-monitoring policy for mobile-computing device 240 may permit mobile-computing device 242 to be located within any of the locations and/or ranges of locations specified in the first location profile or the second location profile during a corresponding recurring time period specified in the location profiles.

In at least one embodiment, monitoring module 214 may determine that mobile-computing device 240 is located within the second range of physical locations, which is outside the first range of physical locations, during an instance of the recurring time period. Although monitoring module 214 may determine that mobile-computing device 242 is outside of the first range of physical locations specified in the first location profile, monitoring module 214 may nonetheless determine that mobile-computing device 242 is within the second range of physical locations specified in the second location profile, and accordingly, monitoring module 214 may determine that an exception to the device-monitoring policy has not occurred.

At step 350 in FIG. 3, the system may implement the device-monitoring policy after detecting that the mobile-computing device is outside the first range of physical locations during the first instance of the recurring time period. As discussed above in reference to step 320, the device-monitoring policy may specify actions to be taken by the system if specified conditions are met. For example, the device-monitoring policy may specify that the administrator be notified if mobile-computing device 240 is located outside of a specified area or range of areas during a specified time period. In some examples, the device-monitoring policy may specify different enforcement actions to be taken by the system in response to different exceptions to the device-monitoring policy. In additional examples, the system may include a device-setting policy that specifies different device setting changes to be enforced by the system in response to different exceptions to the device-setting policy.

One or more enforcement modules may be used to implement and enforce the device-monitoring policy and/or the device-setting policy. For example, mobile-computing device 240 of the user may comprise an enforcement module 246. In some embodiments, computing device 230 of the administrator may also comprise an enforcement module 236, as illustrated in FIG. 2. Enforcement module 246 and/or enforcement module 236 may implement the device-monitoring policy and/or the device-setting policy on mobile-computing device 240 and/or computing device 230. For example, enforcement module 246 and/or enforcement module 236 may notify the administrator and/or the user of an exception to the device-monitoring policy by any suitable method, including, without limitation, sending an email to an email address of the administrator and/or user, sending a text message to a mobile-computing device of the administrator and/or user, and/or sending an automated phone message to a computing device or communication device of the administrator and/or user. In some embodiments, enforcement module 236 and/or enforcement module 246 may telephonically connect an administrator's computing device 230 with a user's mobile-computing device 240 when monitoring module 214 detects an exception to the device-monitoring policy and/or the device-setting policy.

FIG. 4 is a flow diagram of another exemplary computer-implemented method 400 for monitoring a mobile-computing device. The steps shown in FIG. 4 may be performed by any suitable computer-executable code and/or computing system. In some embodiments, the steps shown in FIG. 4 may be performed by one or more of the components of system 100 in FIG. 1, one or more of the elements of system 200 in FIG. 2, and/or one or more of the elements of system 500 in FIG. 5, as will be explained in greater detail below.

At step 410 in FIG. 4, the system may determine that a user is located within a first range of physical locations during a first time period having a first length of time. For example, during a commute to school, the user may be located at several locations along the commuting route during a time period having a first length of time, such as a length of approximately 15 minutes.

At step 420 in FIG. 4, the system may generate a location profile for a mobile-computing device of the user. The location profile may correlate the first range of physical locations with the first length of time. For example, the length of time may be associated with a range of physical locations within which the user may be located during a particular recurring activity. In some embodiments, the location profile may be labeled according to the recurring activity.

At step 430 in FIG. 4, the system may receive a device-monitoring policy for the mobile-computing device from an administrator. The device-monitoring policy may be stored in profile-management module 212. In some examples, the device-monitoring policy may specify actions to be enforced by the system if mobile-computing device 240 is located outside of a specified area and/or range of areas during a time period having a length of time approximately equal to the first length of time.

At step 440 in FIG. 4, the system may detect, after the learning phase that the mobile-computing device is outside the first range of physical locations during a second time period having a length approximately equal to the first length of time. At step 450 in FIG. 4, the system may implement the device-monitoring policy after detecting that the mobile-computing device is outside the first range of physical locations during the second time period.

As mentioned previously, exemplary system 100 in FIG. 1 may be configured in a variety of ways. For example, all or a portion of exemplary system 100 may represent portions of network-based system 500 illustrated in FIG. 5. FIG. 5 is a block diagram of an exemplary system 500 for monitoring a mobile-computing device. As illustrated in this figure, exemplary system 500 may include a server 510, a computing device 530, a mobile-computing device 540, and a mobile-computing device 550, all connected to a network 520. Server 510 generally represents any type or form of computing device capable of reading computer-executable instructions, including, for example, an application server configured to run certain software applications, and/or a database server configured to provide various database services. Server 510 may include a profile-management module 512, a monitoring module 514, and a database 516.

Computing device 530 generally represents any type or form of computing device capable of reading computer-executable instructions. Examples of computing device 530 include, without limitation, laptops, desktops, servers, cellular phones, smart phones, personal digital assistants ("PDAs"), multimedia players, game consoles, embedded systems, combinations of one or more of the same, exemplary computing system 610 in FIG. 6, or any other suitable computing device. Computing device 530 may include an interface 532 and an enforcement module 536. Interface 532 may include an administrator input module 534 configured to receive setting and location input from an administrator.

Mobile-computing device 540 and mobile-computing device 550 may each represent any type or form of mobile-computing device, such as a mobile-communication device. Examples of mobile-computing device 540 and mobile-computing device 550 include, without limitation, cellular phones, smart phones, personal digital assistants ("PDAs"), global positioning system ("GPS") receivers, combinations of one or more of the same, or any other suitable computing device. Mobile-computing device 540 may include an interface 542, and an enforcement module 546. Interface 542 may include an administrator input module 544 configured to receive setting and location input from an administrator. Mobile-computing device 550 may include an interface 552, an enforcement module 556, and a location transmitting module 558.

According to various embodiments, the administrator may use both computing device 530 and mobile-computing device 540 to set system policies, to monitor locations of mobile-computing device 550 carried by a user, to receive notifications concerning mobile-computing device 550, and/or to carry out any other suitable administrator-based activities. For example, computing device 530 may comprise a desktop computer used by the administrator and mobile-computing device 540 may comprise a mobile-communication device used by the administrator. The administrator may, for example, input device-monitoring policy settings and/or view maps showing tracked locations of mobile-computing device 550 via administrator interface 532 on computing device 530. Additionally, the administrator may, for example, receive updates and notifications and may communicate with mobile-computing device 550 of the user via administrator interface 542 on mobile-computing device 540.

Network 520 generally represents any medium or architecture capable of facilitating communication or data transfer. Examples of network 220 include, without limitation, an intranet, a wide area network ("WAN"), a local area network ("LAN"), a personal area network ("PAN"), the Internet, power line communications ("PLC"), a cellular network (e.g., a GSM Network), exemplary network architecture 700 in FIG. 7, or the like. In at least one embodiment, network 520 may facilitate communication between server 510, computing device 530, mobile-computing device 540, and/or mobile-computing device 540.

Figure 6:
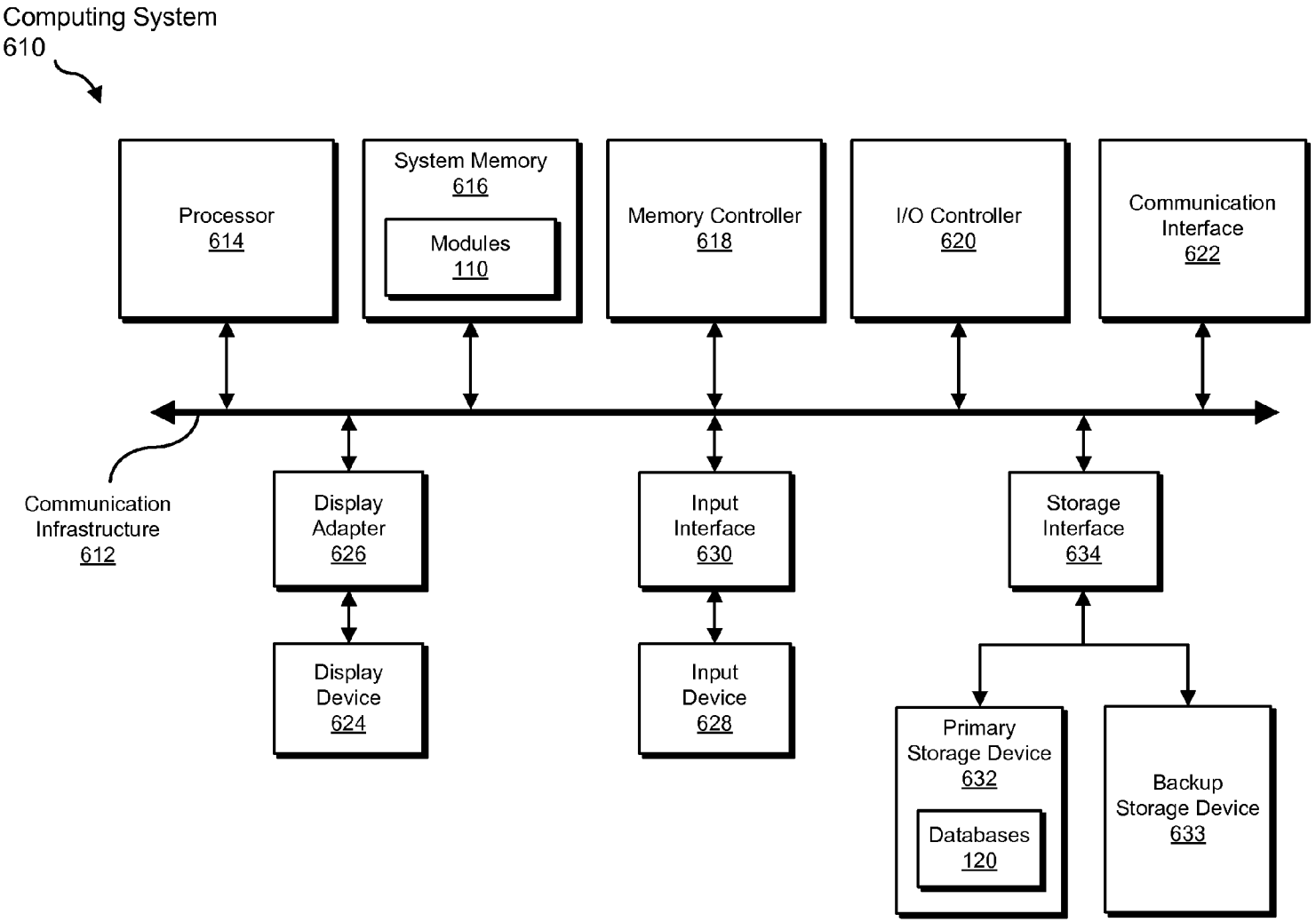
FIG. 6 is a block diagram of an exemplary computing system capable of implementing one or more of the embodiments described and/or illustrated herein.

FIG. 6 is a block diagram of an exemplary computing system 610 capable of implementing one or more of the embodiments described and/or illustrated herein. Computing system 610 broadly represents any single or multi-processor computing device or system capable of executing computer-readable instructions. Examples of computing system 610 include, without limitation, workstations, laptops, client-side terminals, servers, distributed computing systems, handheld devices, or any other computing system or device. In its most basic configuration, computing system 610 may include at least one processor 614 and a system memory 616.

Processor 614 generally represents any type or form of processing unit capable of processing data or interpreting and executing instructions. In certain embodiments, processor 614 may receive instructions from a software application or module. These instructions may cause processor 614 to perform the functions of one or more of the exemplary embodiments described and/or illustrated herein. For example, processor 614 may perform and/or be a means for performing, either alone or in combination with other elements, one or more of the sharing, determining, monitoring, creating, providing, receiving, storing, identifying, using, extracting, associating, and/or formatting steps described herein. Processor 614 may also perform and/or be a means for performing any other steps, methods, or processes described and/or illustrated herein.

System memory 616 generally represents any type or form of volatile or non-volatile storage device or medium capable of storing data and/or other computer-readable instructions. Examples of system memory 616 include, without limitation, random access memory ("RAM"), read only memory ("ROM"), flash memory, or any other suitable memory device. Although not required, in certain embodiments computing system 610 may include both a volatile memory unit (such as, for example, system memory 616) and a non-volatile storage device (such as, for example, primary storage device 632, as described in detail below). In one example, one or more of modules 110 from FIG. 1 may be loaded into system memory 616.

In certain embodiments, exemplary computing system 610 may also include one or more components or elements in addition to processor 614 and system memory 616. For example, as illustrated in FIG. 6, computing system 610 may include a memory controller 618, an Input/Output ("I/O") controller 620, and a communication interface 622, each of which may be interconnected via a communication infrastructure 612. Communication infrastructure 612 generally represents any type or form of infrastructure capable of facilitating communication between one or more components of a computing device. Examples of communication infrastructure 612 include, without limitation, a communication bus (such as an ISA, PCI, PCIe, or similar bus) and a network.

Memory controller 618 generally represents any type or form of device capable of handling memory or data or controlling communication between one or more components of computing system 610. For example, in certain embodiments memory controller 618 may control communication between processor 614, system memory 616, and I/O controller 620 via communication infrastructure 612. In certain embodiments, memory controller may perform and/or be a means for performing, either alone or in combination with other elements, one or more of the steps or features described and/or illustrated herein, such as determining, generating, receiving, sending, detecting, implementing, providing, and/or updating.

I/O controller 620 generally represents any type or form of module capable of coordinating and/or controlling the input and output functions of a computing device. For example, in certain embodiments I/O controller 620 may control or facilitate transfer of data between one or more elements of computing system 610, such as processor 614, system memory 616, communication interface 622, display adapter 626, input interface 630, and storage interface 634. I/O controller 620 may be used, for example, to perform and/or be a means for performing, either alone or in combination with other elements, one or more of the determining, generating, receiving, sending, detecting, implementing, providing, and/or updating steps described herein. I/O controller 620 may also be used to perform and/or be a means for performing other steps and features set forth in the instant disclosure.

Communication interface 622 broadly represents any type or form of communication device or adapter capable of facilitating communication between exemplary computing system 610 and one or more additional devices. For example, in certain embodiments communication interface 622 may facilitate communication between computing system 610 and a private or public network including additional computing systems. Examples of communication interface 622 include, without limitation, a wired network interface (such as a network interface card), a wireless network interface (such as a wireless network interface card), a modem, and any other suitable interface. In at least one embodiment, communication interface 622 may provide a direct connection to a remote server via a direct link to a network, such as the Internet. Communication interface 622 may also indirectly provide such a connection through, for example, a local area network (such as an Ethernet network), a personal area network, a telephone or cable network, a cellular telephone connection, a satellite data connection, or any other suitable connection.

In certain embodiments, communication interface 622 may also represent a host adapter configured to facilitate communication between computing system 610 and one or more additional network or storage devices via an external bus or communications channel. Examples of host adapters include, without limitation, SCSI host adapters, USB host adapters, IEEE 694 host adapters, SATA and eSATA host adapters, ATA and PATA host adapters, Fibre Channel interface adapters, Ethernet adapters, or the like. Communication interface 622 may also allow computing system 610 to engage in distributed or remote computing. For example, communication interface 622 may receive instructions from a remote device or send instructions to a remote device for execution. In certain embodiments, communication interface 622 may perform and/or be a means for performing, either alone or in combination with other elements, one or more of the determining, generating, receiving, sending, detecting, implementing, providing, and/or updating steps disclosed herein. Communication interface 622 may also be used to perform and/or be a means for performing other steps and features set forth in the instant disclosure.

As illustrated in FIG. 6, computing system 610 may also include at least one display device 624 coupled to communication infrastructure 612 via a display adapter 626. Display device 624 generally represents any type or form of device capable of visually displaying information forwarded by display adapter 626. Similarly, display adapter 626 generally represents any type or form of device configured to forward graphics, text, and other data from communication infrastructure 612 (or from a frame buffer, as known in the art) for display on display device 624.

As illustrated in FIG. 6, exemplary computing system 610 may also include at least one input device 628 coupled to communication infrastructure 612 via an input interface 630. Input device 628 generally represents any type or form of input device capable of providing input, either computer or human generated, to exemplary computing system 610. Examples of input device 628 include, without limitation, a keyboard, a pointing device, a speech recognition device, or any other input device. In at least one embodiment, input device 628 may perform and/or be a means for performing, either alone or in combination with other elements, one or more of the determining, generating, receiving, sending, detecting, implementing, providing, and/or updating steps disclosed herein. Input device 628 may also be used to perform and/or be a means for performing other steps and features set forth in the instant disclosure.

As illustrated in FIG. 6, exemplary computing system 610 may also include a primary storage device 632 and a backup storage device 633 coupled to communication infrastructure 612 via a storage interface 634. Storage devices 632 and 633 generally represent any type or form of storage device or medium capable of storing data and/or other computer-readable instructions. For example, storage devices 632 and 633 may be a magnetic disk drive (e.g., a so-called hard drive), a floppy disk drive, a magnetic tape drive, an optical disk drive, a flash drive, or the like. Storage interface 634 generally represents any type or form of interface or device for transferring data between storage devices 632 and 633 and other components of computing system 610. In one example, database 120 from FIG. 1 may be stored in primary storage device 632.

In certain embodiments, storage devices 632 and 633 may be configured to read from and/or write to a removable storage unit configured to store computer software, data, or other computer-readable information. Examples of suitable removable storage units include, without limitation, a floppy disk, a magnetic tape, an optical disk, a flash memory device, or the like. Storage devices 632 and 633 may also include other similar structures or devices for allowing computer software, data, or other computer-readable instructions to be loaded into computing system 610. For example, storage devices 632 and 633 may be configured to read and write software, data, or other computer-readable information. Storage devices 632 and 633 may also be a part of computing system 610 or may be a separate device accessed through other interface systems.

In certain embodiments, storage devices 632 and 633 may be used, for example, to perform and/or be a means for performing, either alone or in combination with other elements, one or more of the determining, generating, receiving, sending, detecting, implementing, providing, and/or updating steps disclosed herein. Storage devices 632 and 633 may also be used to perform and/or be a means for performing other steps and features set forth in the instant disclosure.

Many other devices or subsystems may be connected to computing system 610. Conversely, all of the components and devices illustrated in FIG. 6 need not be present to practice the embodiments described and/or illustrated herein. The devices and subsystems referenced above may also be interconnected in different ways from that shown in FIG. 6. Computing system 610 may also employ any number of software, firmware, and/or hardware configurations. For example, one or more of the exemplary embodiments disclosed herein may be encoded as a computer program (also referred to as computer software, software applications, computer-readable instructions, or computer control logic) on a computer-readable medium. The phrase "computer-readable medium" generally refers to any form of device, carrier, or medium capable of storing or carrying computer-readable instructions. Examples of computer-readable media include, without limitation, transmission-type media, such as carrier waves, and physical media, such as magnetic-storage media (e.g., hard disk drives and floppy disks), optical-storage media (e.g., CD- or DVD-ROMs), electronic-storage media (e.g., solid-state drives and flash media), and other distribution systems.

The computer-readable medium containing the computer program may be loaded into computing system 610. All or a portion of the computer program stored on the computer-readable medium may then be stored in system memory 616 and/or various portions of storage devices 632 and 633. When executed by processor 614, a computer program loaded into computing system 610 may cause processor 614 to perform and/or be a means for performing the functions of one or more of the exemplary embodiments described and/or illustrated herein. Additionally or alternatively, one or more of the exemplary embodiments described and/or illustrated herein may be implemented in firmware and/or hardware. For example, computing system 610 may be configured as an application specific integrated circuit ("ASIC") adapted to implement one or more of the exemplary embodiments disclosed herein.

Figure 7:
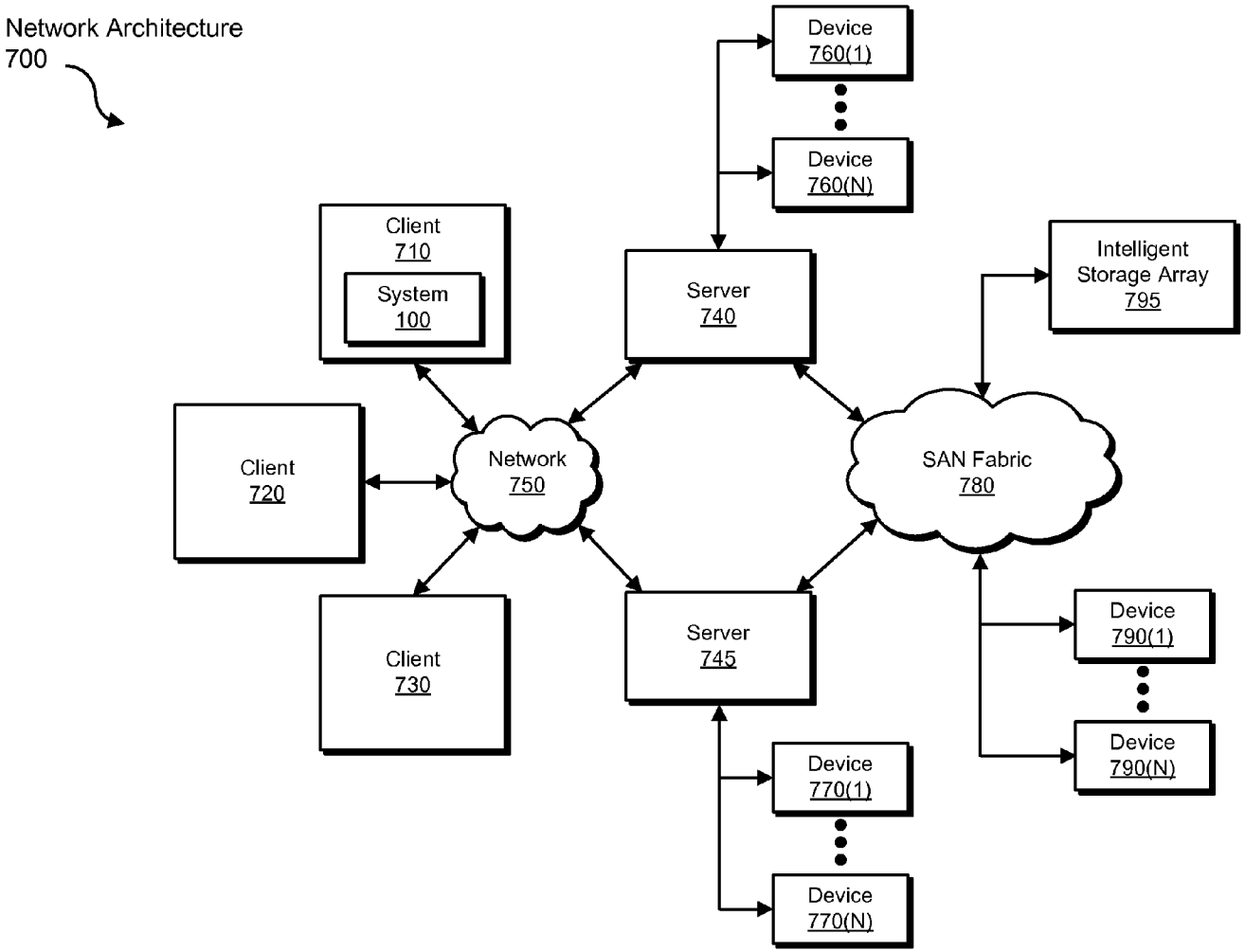
FIG. 7 is a block diagram of an exemplary computing network capable of implementing one or more of the embodiments described and/or illustrated herein.

FIG. 7 is a block diagram of an exemplary network architecture 700 in which client systems 710, 720, and 730 and servers 740 and 745 may be coupled to a network 750. Client systems 710, 720, and 730 generally represent any type or form of computing device or system, such as exemplary computing system 610 in FIG. 6. In one example, client system 710 may include all or a portion of system 100 from FIG. 1.

Similarly, servers 740 and 745 generally represent computing devices or systems, such as application servers or database servers, configured to provide various database services and/or run certain software applications. Network 750 generally represents any telecommunication or computer network including, for example, an intranet, a wide area network ("WAN"), a local area network ("LAN"), a personal area network ("PAN"), or the Internet.

As illustrated in FIG. 7, one or more storage devices 760(1)-(N) may be directly attached to server 740. Similarly, one or more storage devices 770(1)-(N) may be directly attached to server 745. Storage devices 760(1)-(N) and storage devices 770(1)-(N) generally represent any type or form of storage device or medium capable of storing data and/or other computer-readable instructions. In certain embodiments, storage devices 760(1)-(N) and storage devices 770(1)-(N) may represent network-attached storage ("NAS") devices configured to communicate with servers 740 and 745 using various protocols, such as NFS, SMB, or CIFS.

Servers 740 and 745 may also be connected to a storage area network ("SAN") fabric 780. SAN fabric 780 generally represents any type or form of computer network or architecture capable of facilitating communication between a plurality of storage devices. SAN fabric 780 may facilitate communication between servers 740 and 745 and a plurality of storage devices 790(1)-(N) and/or an intelligent storage array 795. SAN fabric 780 may also facilitate, via network 750 and servers 740 and 745, communication between client systems 710, 720, and 730 and storage devices 790(1)-(N) and/or intelligent storage array 795 in such a manner that devices 790(1)-(N) and array 795 appear as locally attached devices to client systems 710, 720, and 730. As with storage devices 760(1)-(N) and storage devices 770(1)-(N), storage devices 790(1)-(N) and intelligent storage array 795 generally represent any type or form of storage device or medium capable of storing data and/or other computer-readable instructions.

In certain embodiments, and with reference to exemplary computing system 610 of FIG. 6, a communication interface, such as communication interface 622 in FIG. 6, may be used to provide connectivity between each client system 710, 720, and 730 and network 750. Client systems 710, 720, and 730 may be able to access information on server 740 or 745 using, for example, a web browser or other client software. Such software may allow client systems 710, 720, and 730 to access data hosted by server 740, server 745, storage devices 760(1)-(N), storage devices 770(1)-(N), storage devices 790(1)-(N), or intelligent storage array 795. Although FIG. 7 depicts the use of a network (such as the Internet) for exchanging data, the embodiments described and/or illustrated herein are not limited to the Internet or any particular network-based environment.

In at least one embodiment, all or a portion of one or more of the exemplary embodiments disclosed herein may be encoded as a computer program and loaded onto and executed by server 740, server 745, storage devices 760(1)-(N), storage devices 770(1)-(N), storage devices 790(1)-(N), intelligent storage array 795, or any combination thereof. All or a portion of one or more of the exemplary embodiments disclosed herein may also be encoded as a computer program, stored in server 740, run by server 745, and distributed to client systems 710, 720, and 730 over network 750. Accordingly, network architecture 700 may perform and/or be a means for performing, either alone or in combination with other elements, one or more of the determining, generating, receiving, sending, detecting, implementing, providing, and/or updating steps disclosed herein. Network architecture 700 may also be used to perform and/or be a means for performing other steps and features set forth in the instant disclosure.

While the foregoing disclosure sets forth various embodiments using specific block diagrams, flowcharts, and examples, each block diagram component, flowchart step, operation, and/or component described and/or illustrated herein may be implemented, individually and/or collectively, using a wide range of hardware, software, or firmware (or any combination thereof) configurations. In addition, any disclosure of components contained within other components should be considered exemplary in nature since many other architectures can be implemented to achieve the same functionality.

The process parameters and sequence of steps described and/or illustrated herein are given by way of example only and can be varied as desired. For example, while the steps illustrated and/or described herein may be shown or discussed in a particular order, these steps do not necessarily need to be performed in the order illustrated or discussed. The various exemplary methods described and/or illustrated herein may also omit one or more of the steps described or illustrated herein or include additional steps in addition to those disclosed.

While various embodiments have been described and/or illustrated herein in the context of fully functional computing systems, one or more of these exemplary embodiments may be distributed as a program product in a variety of forms, regardless of the particular type of computer-readable media used to actually carry out the distribution. The embodiments disclosed herein may also be implemented using software modules that perform certain tasks. These software modules may include script, batch, or other executable files that may be stored on a computer-readable storage medium or in a computing system. In some embodiments, these software modules may configure a computing system to perform one or more of the exemplary embodiments disclosed herein.

One or more of the software modules described herein may transform data, physical devices, and/or representations of physical devices from one form to another. For example, monitoring module 114 may transform the state of a data storage device by storing location data to the data storage device.

The preceding description has been provided to enable others skilled in the art to best utilize various aspects of the exemplary embodiments disclosed herein. This exemplary description is not intended to be exhaustive or to be limited to any precise form disclosed. Many modifications and variations are possible without departing from the spirit and scope of the instant disclosure. The embodiments disclosed herein should be considered in all respects illustrative and not restrictive. Reference should be made to the appended claims and their equivalents in determining the scope of the instant disclosure.

Unless otherwise noted, the terms "a" or "an," as used in the specification and claims, are to be construed as meaning "at least one of." In addition, for ease of use, the words "including" and "having," as used in the specification and claims, are interchangeable with and have the same meaning as the word "comprising."

What is claimed is:

1. A computer-implemented method for monitoring a mobile-computing device using geo-location information, at least a portion of the method being performed by a computing device comprising at least one processor, the method comprising:

determining, during a learning phase, that a user is located within a first range of physical locations during a recurring time period;

generating a location profile for a mobile-computing device of the user, the location profile correlating the first range of physical locations with the recurring time period;

receiving a device-monitoring policy for the mobile-computing device from an administrator;

detecting, after the learning phase, that the mobile-computing device is outside the first range of physical locations during a first instance of the recurring time period;

implementing the device-monitoring policy after detecting that the mobile-computing device is outside the first range of physical locations during the first instance of the recurring time period.

2. The method of claim 1, wherein determining, during the learning phase, that the user is located within the first range of physical locations during the recurring time period comprises detecting that the mobile-computing device is within one or more physical locations within the first range of physical locations during a plurality of learning instances of the recurring time period.

3. The method of claim 1, wherein determining, during the learning phase, that the user is located within the first range of physical locations during the recurring time period comprises:

detecting that the mobile-computing device is within a first physical location within the first range of physical locations during a first learning instance of the recurring time period;

detecting that the mobile-computing device is within a second physical location within the first range of physical locations during a second learning instance of the recurring time period.

4. The method of claim 1, wherein:

the user is a child;

the administrator is a guardian of the child.

5. The method of claim 1, wherein the recurring time period recurs at intervals specified by the administrator.

6. The method of claim 1, wherein the recurring time period recurs according to a schedule specified by the administrator.

7. The method of claim 1, wherein the location profile comprises at least one of:

coordinates within the first range of physical locations;

boundaries of the first range of physical locations;

addresses within the first range of physical locations.

8. The method of claim 1, wherein implementing the device-monitoring policy comprises notifying the administrator that the mobile-computing device is outside the first range of physical locations during the first instance of the recurring time period.

9. The method of claim 8, wherein notifying the administrator comprises at least one of:

sending an email to the administrator;

sending a text message to a mobile-computing device of the administrator;

sending an automated phone message to the administrator.

10. The method of claim 1, wherein implementing the device-monitoring policy comprises telephonically connecting a computing device of the administrator to the mobile-computing device of the user.

11. The method of claim 1, further comprising:

providing the administrator with access to device-setting policies of the mobile-computing device of a user;

receiving a device-setting policy for the mobile-computing device from the administrator;

implementing the device-setting policy on the mobile-computing device after detecting that the mobile-computing device is outside the first range of physical locations during the first instance of the recurring time period.

12. The method of claim 11, wherein the device-setting policy comprises at least one of:

a ringer setting;

a lighting setting;

a power setting;

an email setting;

a voicemail setting;

a network setting;

a sound setting;

a camera setting;

a global positioning system setting;

a messaging setting;

a Bluetooth setting;

an infrared data-association setting;

an installed application setting;

a built-in application setting.

13. The method of claim 1, further comprising:

receiving a request to override the device-monitoring policy for the mobile-computing device from the user;

sending the override request to the administrator;

receiving authorization from the administrator to override the device-monitoring policy.

14. The method of claim 1, further comprising:

determining, during an update phase, that the user is located within a physical location outside the first range of physical locations during a second instance of the recurring time period;

updating the location profile for the mobile-computing device of the user, the location profile correlating a second range of physical locations with the recurring time period, the second range of physical locations including the physical location outside the first range of physical locations.

15. The method of claim 1, tangibly embodied as computer-executable instructions on at least one computer-readable medium.

16. A computer-implemented method for monitoring a mobile-computing device using geo-location information, at least a portion of the method being performed by a computing device comprising at least one processor, the method comprising:

determining, during a learning phase, that a user is located within a first range of physical locations during a first time period having a first length of time;

generating a location profile for a mobile-computing device of the user, the location profile correlating the first range of physical locations with the first length of time;

receiving a device-monitoring policy for the mobile-computing device from an administrator;

detecting, after the learning phase, that the mobile-computing device is outside the first range of physical locations during a second time period having a length approximately equal to the first length of time;

implementing the device-monitoring policy after detecting that the mobile-computing device is outside the first range of physical locations during the second time period.

17. The method of claim 16, further comprising:

determining, during the learning phase, that the user is located within the first range of physical locations according to a first sequence during the first time period;

detecting, after the learning phase, that the mobile-computing device is located within the first range of physical locations according to a second sequence during the second time period, the second sequence differing from the first sequence;

implementing the device-monitoring policy after detecting that the mobile-computing device is located within the first range of physical locations according to the second sequence.

18. The method of claim 16, tangibly embodied as computer-executable instructions on at least one computer-readable medium.

19. A system for monitoring a mobile-computing device using geo-location information, the system comprising:

an interface programmed to receive a device-monitoring policy for a mobile-computing device of a user from an administrator;

a profile-management module programmed to generate a location profile for the mobile-computing device, the location profile comprising a first range of physical locations correlated with a recurring time period;

a monitoring module programmed to detect that the mobile-computing device is outside the first range of physical locations during a first instance of the recurring time period;

an enforcement module configured to implement the device-monitoring policy after detecting that the mobile-computing device is outside the first range of physical locations during the first instance of the recurring time period;

one or more processors configured to execute the interface, the profile-management module, the monitoring module, and the enforcement module.

20. The system of claim 19, wherein the interface comprises at least one of:

a drop-down menu comprising a first setting option and a second setting option, the device-setting policy comprising the first setting option;

a text-box configured to receive input from the administrator;

a button configured to allow the administrator to select between the first setting option and the second setting option.

* * * * *